US007934295B2

(12) United States Patent
Saeger et al.

(10) Patent No.: US 7,934,295 B2
(45) Date of Patent: May 3, 2011

(54) APPARATUS AND METHOD FOR THE FIBRE-SORTING OR FIBRE-SELECTION OF A FIBRE BUNDLE COMPRISING TEXTILE FIBRES

(75) Inventors: Nicole Saeger, Aachen (DE); Johannes Bossmann, Mönchengladbach (DE); Thomas Schmitz, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 383 days.

(21) Appl. No.: 12/163,509

(22) Filed: Jun. 27, 2008

(65) Prior Publication Data

US 2009/0000078 A1 Jan. 1, 2009

(30) Foreign Application Priority Data

Jun. 29, 2007 (DE) ..... 10 2007 030 471
Jun. 29, 2007 (DE) ..... 20 2007 010 686 U
Feb. 14, 2008 (DE) ..... 10 2008 009 391

(51) Int. Cl.
*D01G 19/00* (2006.01)

(52) U.S. Cl. ..... 19/217

(58) Field of Classification Search ..... 19/115 R, 19/128, 215, 216, 217
See application file for complete search history.

(56) References Cited

U.S. PATENT DOCUMENTS 1,408,780 A * 3/1922 Schleifer ..... 19/217
1,425,059 A * 8/1922 Schleifer ..... 19/217
1,694,432 A * 12/1928 Schleifer ..... 19/217
1,708,032 A * 4/1929 Schleifer ..... 19/217
1,715,473 A * 6/1929 Schleifer ..... 19/217
1,799,066 A * 3/1931 Schleifer ..... 19/217
2,044,460 A * 6/1936 Bartram et al. ..... 19/99
2,962,772 A 12/1960 Draving et al.
3,108,333 A * 10/1963 Schleifer ..... 19/235
4,270,245 A 6/1981 Stewart et al.
5,007,623 A 4/1991 Unkuri et al.
5,343,686 A 9/1994 Buchner et al.
5,404,619 A 4/1995 Jorg
5,457,851 A 10/1995 Mondini (Continued)

FOREIGN PATENT DOCUMENTS

DE 367482 C 1/1923

(Continued)

OTHER PUBLICATIONS

German Patent Office Search Report, dated Aug. 8, 2007, issued in related German Patent Application No. 10 2006 050 384.8, and English language translation of Section C.

(Continued)

*Primary Examiner* — Shaun R Hurley
(74) *Attorney, Agent, or Firm* — Venable LLP; Robert Kinberg; Steven J. Schwarz

(57) ABSTRACT

In an apparatus and a method for the fibre-sorting or fibre-selection of a fibre bundle comprising textile fibres, especially for combing, which is supplied by means of supply device to a fibre-sorting device, especially a combing device, and which is removed by a take-off device, to enable the productivity to be substantially increased and an improved combed bundle to be obtained, downstream of the supply device there are arranged at least two rotatably mounted rollers rotating rapidly without interruption, which are provided with clamping devices for the fibre bundle, wherein an actuating device for adjusting geometric and/or speed-related variables in the relationship of the rollers to one another are associated with at least one roller.

24 Claims, 7 Drawing Sheets

U.S. PATENT DOCUMENTS

| | | | |
|---|---|---|---|
| 5,502,875 | A | 4/1996 | Stolz et al. |
| 5,796,220 | A | 8/1998 | Clapp et al. |
| 6,163,931 | A | 12/2000 | Leifeld |
| 6,173,478 | B1 | 1/2001 | Patelli et al. |
| 6,216,318 | B1 | 4/2001 | Leifeld |
| 6,235,999 | B1 | 5/2001 | Rubenach |
| 6,295,699 | B1 | 10/2001 | Temburg |
| 6,499,194 | B1 | 12/2002 | Gresser et al. |
| 6,611,994 | B2 | 9/2003 | Bischofberger et al. |
| 7,173,207 | B2 | 2/2007 | Losbrock et al. |
| 2002/0124354 | A1 | 9/2002 | Pferdmenges et al. |
| 2003/0005551 | A1 | 1/2003 | Schurenkramer et al. |
| 2003/0029003 | A1 | 2/2003 | Breuer et al. |
| 2003/0070260 | A1 | 4/2003 | Rubenach |
| 2003/0154572 | A1 | 8/2003 | Pferdmenges et al. |
| 2004/0040121 | A1 | 3/2004 | Schmitz |
| 2004/0128799 | A1 | 7/2004 | Hosel et al. |
| 2005/0076476 | A1 | 4/2005 | Temburg |
| 2005/0198783 | A1 | 9/2005 | Rubenach |
| 2005/0278900 | A1 | 12/2005 | Dammig |
| 2006/0260100 | A1 | 11/2006 | Duda et al. |
| 2007/0180658 | A1 | 8/2007 | Saeger et al. |
| 2007/0180659 | A1 | 8/2007 | Saeger et al. |
| 2007/0180660 | A1 | 8/2007 | Saeger et al. |
| 2007/0266528 | A1 | 11/2007 | Farber et al. |
| 2008/0092339 | A1 | 4/2008 | Bossman et al. |
| 2009/0000064 | A1 | 1/2009 | Saeger et al. |
| 2009/0000065 | A1 | 1/2009 | Saeger et al. |
| 2009/0000066 | A1 | 1/2009 | Saeger et al. |
| 2009/0000067 | A1* | 1/2009 | Leder et al. ..... 19/115 R |
| 2009/0000068 | A1* | 1/2009 | Saeger et al. ..... 19/115 R |
| 2009/0000069 | A1 | 1/2009 | Saeger et al. |
| 2009/0000070 | A1 | 1/2009 | Saeger et al. |
| 2009/0000071 | A1 | 1/2009 | Saeger et al. |
| 2009/0000072 | A1 | 1/2009 | Saeger et al. |
| 2009/0000073 | A1* | 1/2009 | Saeger et al. ..... 19/115 R |
| 2009/0000074 | A1 | 1/2009 | Bossmann |
| 2009/0000075 | A1 | 1/2009 | Saeger et al. |
| 2009/0000076 | A1 | 1/2009 | Bossmann et al. |
| 2009/0000077 | A1 | 1/2009 | Saeger et al. |
| 2009/0000079 | A1 | 1/2009 | Bossmann |

FOREIGN PATENT DOCUMENTS

| | | | |
|---|---|---|---|
| DE | 382169 | C | 9/1923 |
| DE | 399885 | C | 7/1924 |
| DE | 489 420 | C | 1/1930 |
| DE | 30 48 501 | A1 | 7/1982 |
| DE | 103 20 452 | A1 | 11/2004 |
| EP | 1 586 682 | A | 10/2005 |
| WO | WO 2006/012758 | A1 | 2/2006 |

OTHER PUBLICATIONS

German Patent Office Search Report dated Jul. 10, 2007, issued in related German Patent Application No. 10 2006 050 453.4, and partial English-language translation.

U.S. Office Action dated Feb. 26, 2010, issued in related U.S. Appl. No. 12/149,506.

* cited by examiner

APPARATUS AND METHOD FOR THE FIBRE-SORTING OR FIBRE-SELECTION OF A FIBRE BUNDLE COMPRISING TEXTILE FIBRES

CROSS REFERENCE TO RELATED APPLICATIONS

The present application claims priority from German Utility Model Application No. 20 2007 010 686.6 dated Jun. 29, 2007 and German Patent Application No. 10 2008 009 391.2 dated Feb. 14, 2008, the entire disclosure of each of which is incorporated herein by reference.

BACKGROUND OF THE INVENTION

The invention relates to an apparatus for the fibre-sorting or selection of a fibre bundle comprising textile fibres, especially for combing.

In a known apparatus, fibre material is supplied by means of a supply device to a fibre-sorting device, especially to a combing device, in which clamping devices are provided, which clamp the fibre bundle at a distance from its free end and mechanical means are present which generate a combing action from the clamping site to the free end of the fibre bundle in order to loosen and remove non-clamped constituents, such as, for example, short fibres, neps, dust and the like from the free end, wherein for removal of the combed fibre material a take-off device is present.

In practice, combing machines are used to free cotton fibres or woollen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre bundle is combed and thus cleaned. The take-off device usually consists of two counter-rotating rollers, which grip the combed fibre tuft and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre tuft supplied by the nipper assembly, a top comb and a fixed-position detaching device for detaching the combed-out fibre tuft from the nipper assembly. The lap ribbon supplied to the nipper assembly is here fed via a feed cylinder to a detaching roller pair. The fibre tuft protruding from the opened nipper passes onto the rearward end of a combed sliver web or fibre web, whereby it enters the clamping nip of the detaching rollers owing to the forward movement of the detaching rollers. The fibres that are not retained by the retaining force of the lap ribbon, or by the nipper, are detached from the composite of the lap ribbon. During this detaching operation, the fibre tuft is additionally pulled by the needles of a top comb. The top comb combs out the rear part of the detached fibre tuft and also holds back neps, impurities and the like. The top comb, for which in structural terms space is required between the movable nipper assembly and the movable detaching roller, has to be constantly cleaned by having air blown through it. For piercing into and removal from the fibre sliver, the top comb has to be driven. Finally, the cleaning effect at this site of jerky movement is sub-optimal. Owing to the differences in speed between the lap ribbon and the detaching speed of the detaching rollers, the detached fibre tuft is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nipper returns to a rear position in which it is closed and presents the fibre tuft protruding from the nipper to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the detaching rollers and the guide rollers, which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed.

SUMMARY OF THE INVENTION

It is an aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres comprising:

a fibre-sorting device having clamping devices for clamping the fibre bundle;

a supply device for supplying a fibre bundle to the fibre sorting device;

a mechanical device for generating a combing action in order to loosen and remove non-clamped constitutes from the fibre bundle; and a take-off device for removal of the combed fibre material from the fibre-sorting device;

wherein the fibre-sorting device comprises, arranged downstream of the supply device, at least first and second rotatably mounted rollers which, in use, rotate rapidly without interruption, at least one of which has clamping devices distributed spaced apart in the region of its periphery, and at least one adjustment device for adjusting geometric and/or speed related variables in the relationship of said first roller and said second roller to one another is associated with at least one of said first and second rollers.

By implementing the functions of clamping and moving the fibre bundles to be combed-out on two high-speed rollers, high operating speeds (nip rates) are achievable—unlike the known apparatus—without large mass accelerations and reversing movements. In particular, the mode of operation is continuous. When high-speed rollers are used, a very substantial increase in hourly production rate (productivity) is achievable which had previously not been considered possible in technical circles. A further advantage is that the rotary rotational movement of the roller with the plurality of clamping devices leads to an unusually rapid supply of a plurality of fibre bundles per unit of time to the first roller and to the second roller. In particular the high rotational speed of the rollers allows production to be substantially increased. The fibre bundles are—unlike the known apparatus—held by a plurality of clamping devices and transported under rotation.

The clamping point at the particular clamping devices advantageously remains constant until the fibre bundles are transferred to the first or second roller, respectively. A relative movement between clamping device and fibre bundle advantageously does not begin until after the fibre bundle has been gripped by the first or second roller respectively and in addition clamping has been terminated. Because a plurality of clamping devices is available for the fibre bundles, in an especially advantageous manner fibre bundles can be supplied to the first and second roller respectively one after the other and in quick succession, without undesirable time delays resulting from just a single supply device. A particular advantage is that the supplied fibre bundles on the first roller (turning rotor) are continuously transported. The speed of the fibre bundle and of the co-operating clamping device is the same. A clamping device on the first roller and a clamping device on the second roller arranged so that, in use, they both clamp a fibre bundle, which is transferred from the first roller to the second roller during operation of the fibre sorting device, are co-operating clamping devices. The clamping devices close and open during the movement in the direction of the transported fibre material. The at least one second roller (which is, preferably, a combing rotor) is arranged downstream of the at least one first roller (which is, preferably, a turning rotor). To form the fibre bundle, the fibre sliver pushed forward by the feed roller is clamped at one end by a clamping device and detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out. With the apparatus according to the invention, a substantially increased productivity is achievable. A further particular advantage is that there are adjustment options between the turning rotor and the combing rotor of a rotor combing machine. Specifically, these may include, for example, the ecartement adjustment, the adjustment of an offset between combing rotor and turning rotor and the choice of certain speed ratios between the two rotors. The ecartement is the distance between two co-operating clamping points, in particular, the distance between co-operating clamping points of a clamping device on the first roller and a clamping device on the second roller. For example, the ecartement may be the distance between the clamping point of a first clamping device on the first roller and the clamping point of a second clamping device on the second roller at the time at which the second clamping device is arranged to first clamp a fibre bundle clamped by the first clamping device, in use. With reference to a first clamping device on the first roller and a second clamping device on the second roller that is arranged to receive a fibre bundle from the first clamping device, the "offset" relates to the angular displacement of the second clamping device relative to the first clamping device when the first clamping device is located at the narrowest point between the first and second rollers, and may be considered to be, or to be represented by, for example, the time difference between the first clamping device on the first roller and the co-operating second clamping device on the second roller passing a fixed point.

The speed ratios are, for example, the rotary speed ratio or circumferential (peripheral) speed ratio. The said adjustment options are used, for example, for adjustment of the comber waste percentage and to influence the delivery behaviour during transfer of the turning rotor tuft to the combing rotor.

The invention further provides an apparatus for the fibre-sorting or fibre-selection of a fibre bundle comprising textile fibres, especially for combing, which is supplied by means of supply device to a fibre-sorting device, especially a combing device, in which clamping devices are provided which clamp the fibre bundle at a distance from its free end, and a mechanical device is present which generate a combing action from the clamping site to the free end of the fibre bundle, in order to loosen and remove non-clamped constituents, such as, for example, short fibres, neps, dust and the like from the free end, wherein a take-off means is present to remove the combed fibre material, characterised in that downstream of the supply device there are arranged at least two rotatably mounted rollers rotating rapidly without interruption, which are provided with clamping devices for the fibre bundle, which clamping devices are distributed spaced apart in the region of the periphery of the rollers, wherein an actuating device for adjusting geometric (a) and/or speed-related variables in the relationship of the rollers to one another is associated with at least one roller.

The invention further provides a method of combing fibre material, comprising feeding a fibre sliver or lap to a first roller having at least one clamping arrangement, rotating the first roller continuously whereby a bundle of fibres is torn away from the sliver or lap and rotates with the first roller, transferring the bundle to a co-operating clamping arrangement on a second roller such that the bundle is held on said second roller with a first end unclamped and a second end clamped, rotating the bundle with said second roller, positioning the bundle during said rotation such that the free end thereof can be combed by a combing device, and adjusting at least one geometric and/or speed-related variable in the relationship of the rollers to one another.

In one embodiment, the first roller is a turning rotor and the second roller is a combing rotor. Advantageously, the adjustment is effected between a turning rotor and a combing rotor of a rotor combing machine. Advantageously, the mechanical device for generating a combing action includes at least one combing element. In one embodiment, the mechanical device includes two combing elements.

Advantageously, an ecartement adjustment is provided. Advantageously, adjustment of an offset between the combing rotor and the turning rotor is provided. Advantageously, adjustment of specific speed ratios between the combing rotor and turning rotor is provided. Advantageously, the ratio of the peripheral speeds is adjustable. Advantageously, the adjustment is to be used for adaptation (change) of the comber waste percentage. Advantageously, the adjustment is usable to influence the delivery behaviour during transfer of the turning rotor bundle (fibre material) to the combing rotor.

Advantageously, the ecartement is alterable by changing the distance between the turning rotor and the combing rotor. In an embodiment with a constant distance between the turning rotor and the combing rotor, the ecartement may, optionally, be altered by the nipper closure time point of the combing rotor nippers. The adjustment of the ecartement may, for example, be dependent on the combing rotor angular position with respect to the narrowest distance between turning rotor and combing rotor in which the combing rotor nippers have closed. For example, the minimum ecartement is present on closure of the combing rotor nippers at the narrowest point between the turning and combing rotors.

In one embodiment, to alter the ecartement in respect of $E_{min}$ (the narrowest point between two rollers), the nipper closure time point is located, seen in the direction of rotation of the combing rotor, before the narrowest point between the turning rotor and the combing rotor. In another embodiment, to alter the ecartement in respect of $E_{min}$, the nipper closure time point is located, seen in the direction of rotation of the combing rotor, after the narrowest point between the turning rotor and the combing rotor. Advantageously, the turning rotor angular position at which the turning rotor nippers open and release the bundle for transfer to the combing rotor is dependent on the nipper closure time point of the combing rotor nippers.

In one embodiment the co-operating combing rotor nippers and turning rotor nippers pass the narrow point between the turning rotor and the combing rotor at the same time and the offset between the turning rotor and the combing rotor is zero. In another embodiment, the combing rotor nippers co-operating with the turning rotor nippers pass the narrow point earlier than the turning rotor nippers with a positive offset. In yet a further embodiment, the combing rotor nippers co-operating with the turning rotor nippers pass the narrow point later than the turning rotor nippers with a negative offset. Advantageously, by changing the offset, it is possible to influence (alter) the transfer behaviour on transfer of the turning rotor bundle to the combing rotor. In one embodiment, by changing the offset, it is possible to influence (alter) the magnitude of the ecartement in addition to the parameters nipper closure time point of the combing rotor nippers and distance between turning rotor and combing rotor.

In one embodiment, the combing rotor and the turning rotor have identical peripheral speeds. In another embodiment, the combing rotor and the turning rotor have different peripheral speeds, so that different speed ratios are adjustable between the rotors. For example, the speed ratios may be adjustable dependent on the selected nipper spacings on the turning rotor and on the combing rotor. Advantageously, with identical nipper spacing, the speed of the one rotor is always a multiple of that of the other rotor. Advantageously, with correspondingly matched nipper spacings on the rotors, any speed ratios can be set. Advantageously, the speed ratio between the rotors has, for example, an influence on the transfer behaviour during transfer of the fibre bundle from the turning rotor onto the combing rotor. Advantageously, turning rotor and the combing rotor have different directions of rotation.

Advantageously, for suction of the supplied fibre bundles, at least one suction device is provided in the region of the transfer of the fibre material from the first roller to the second roller associated with the clamping devices.

DETAILED DESCRIPTION OF CERTAIN PREFERRED EMBODIMENTS

Figure 1:
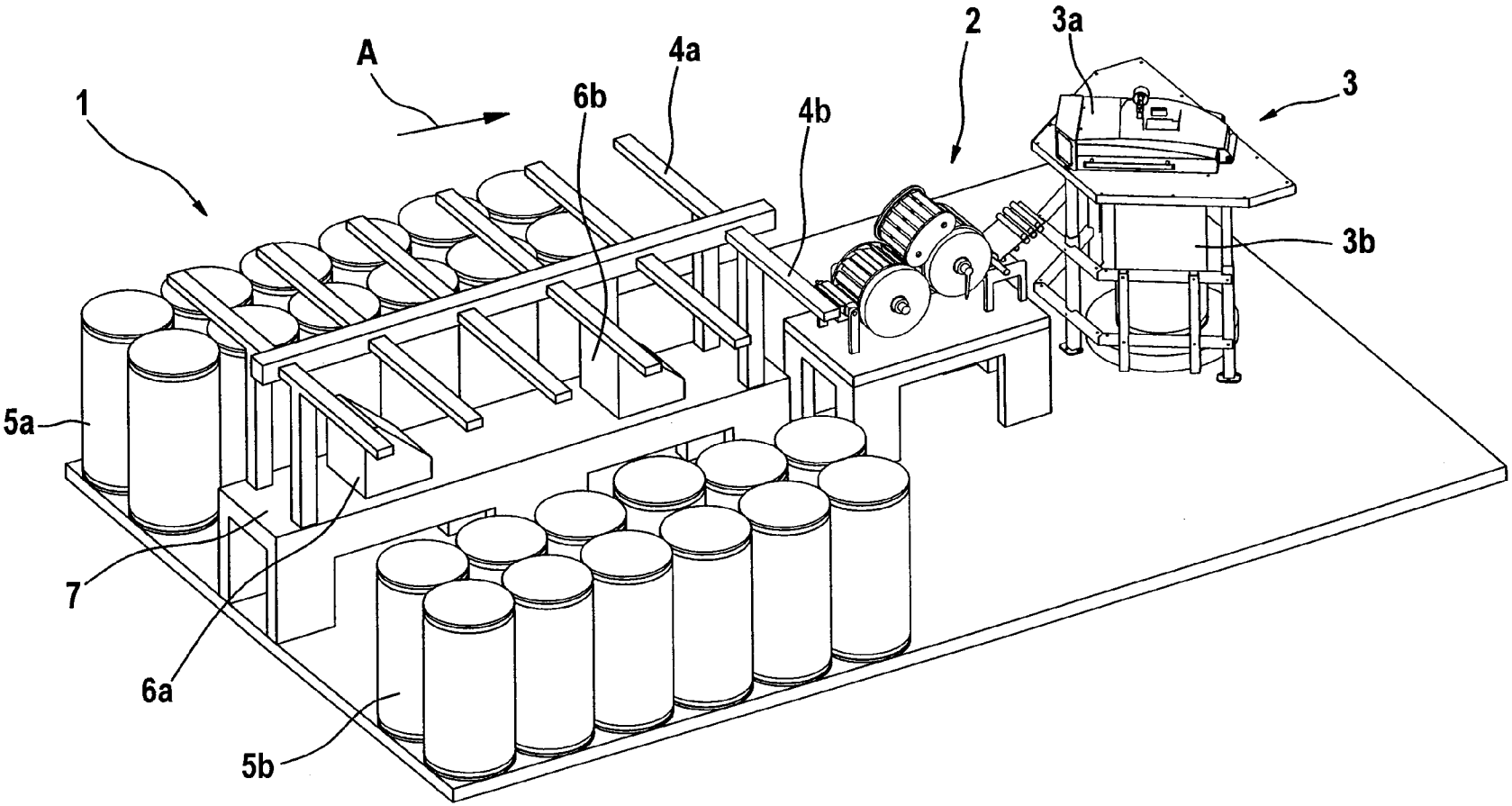
FIG. 1 is a diagrammatic perspective view of a device for combing fibre material, comp rising a combing preparation device, a rotor combing machine and a sliver-deposition device.

In the embodiment of FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further embodiment, more than one rotor combing machine 2 is provided. If, for example, two rotor combing machines are present, then the two delivered comber slivers 17 can pass together through the downstream autoleveller drafting system 50 and be deposited as one drafted comber sliver in the sliver-deposition device 3.

The sliver-deposition device 3 comprises a rotating coiler head 3*a*, by which the comber sliver can be deposited in a can 3*b* or (not shown) in the form of a can-less fibre sliver package.

Figure 2:
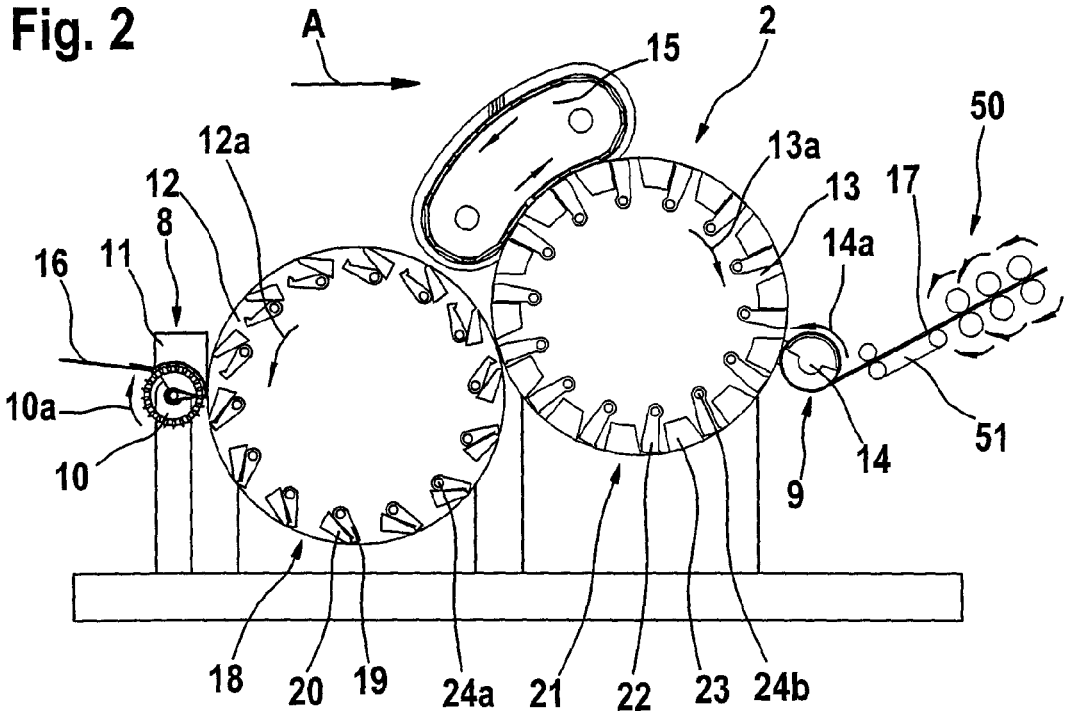
FIG. 2 is a diagrammatic side view of a rotor combing machine according to the invention having two rollers and a combing element.

FIG. 2 shows an embodiment comprising a rotor combing machine 2 having a supply device 8 comprising a feed roller 10 and a feed trough 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a*, which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a fibre lap 16 (clamping) and release it.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is mounted on the roller 13 so as to be either fixed or movable. The free end of the upper nipper 22 faces the periphery of the roller 13. The upper nipper 22 and the lower nipper 23 co-operate so that they are able to grip a fibre bundle (clamping) and release it. In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. Reference numeral 51 denotes a driven ascending conveyor, for example a conveyor belt. It is also possible to use an upwardly inclined metal sheet or the like for conveying purposes.

Figure 3:
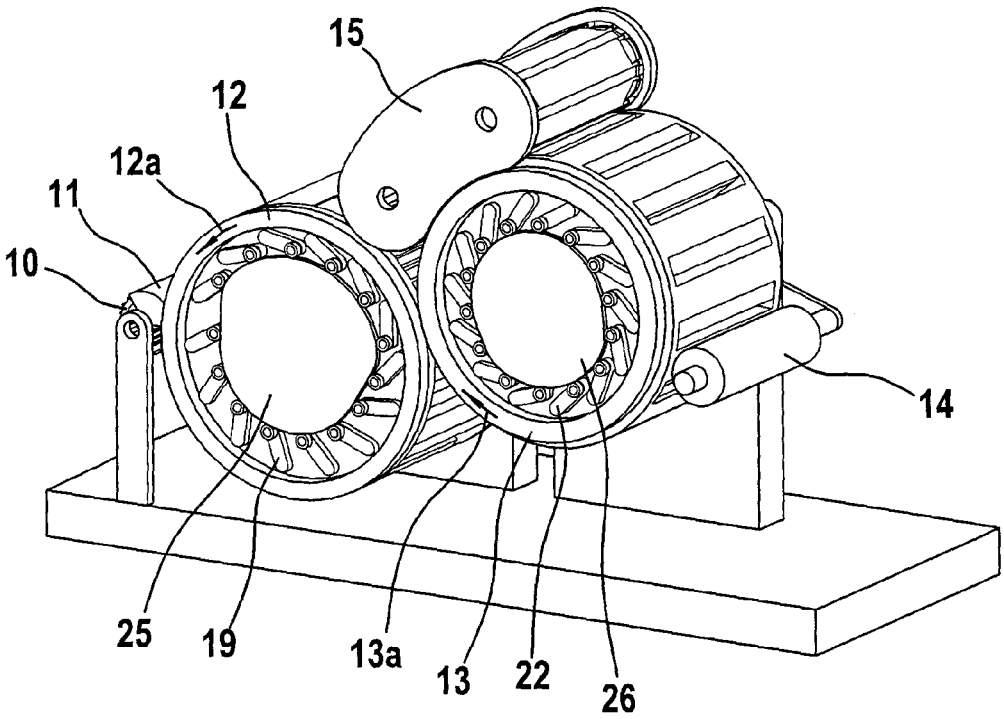
FIG. 3 is a perspective view of the rotor combing machine according to FIG. 2 having two cam discs.

In the embodiment of FIG. 3, the rollers 12,13 of the fibre-sorting device 2 have two fixed cam discs 25 and 26, about which the roller 12 having the first clamping devices 18 and the roller 13 having the second clamping device 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26 respectively, the upper nippers 19 and 22 are rotated about pivot axes 24*a* and 24*b*, respectively. In that way, the opening and closing of the first clamping devices 18 and the second clamping devices 21 is implemented.

Figure 4:
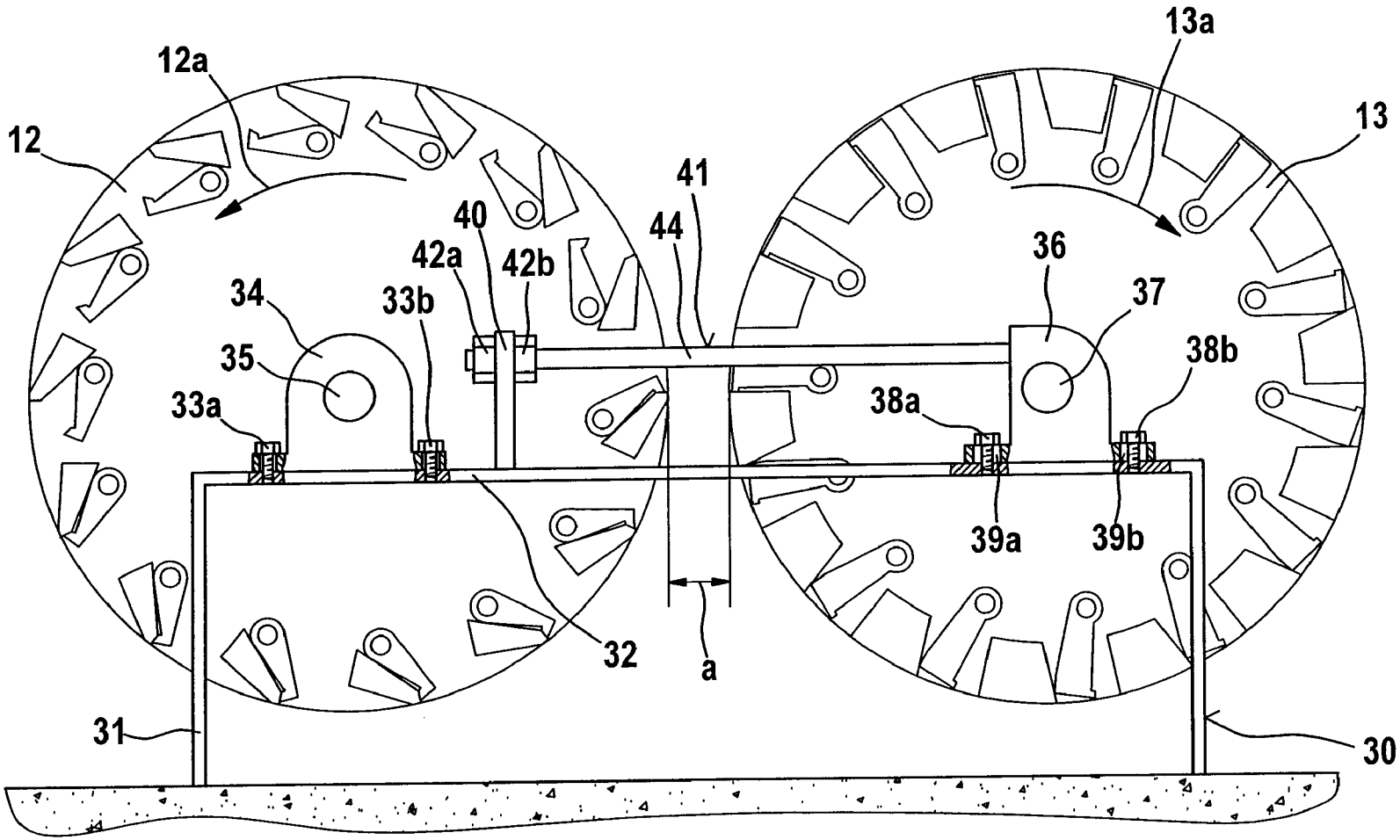
FIG. 4 is a diagrammatic view of an actuating device for changing the distance between the turning rotor and combing rotor (spacing of cylindrical surfaces) with manual adjustment and fixing.

In the embodiment of FIG. 4, a stationary base frame 30 of the rotor combing machine is in the form of a framework with four supports 31 (only two are shown) and with two horizontal longitudinal supports 32 (only one is shown). The two longitudinal supports 32 and the supports 31 are interconnected by cross members (not shown) to form a stable, rigid supporting frame for the rotating rollers 12 and 13 operating with a small mutual spacing a. The turning rotor 12 is mounted in fixed position by means of two support elements 34 (only one is shown in FIG. 4) bolted fixedly with bolts 33*a*, 33*b* to the longitudinal supports 32, and so as to be rotatable about its axle 35, and is driven by devices (not shown) and rotated anticlockwise (in the direction of the arrow 12*a*). The combing rotor 13 is likewise mounted by means of two support elements 36 (only one is shown in FIG. 4) on the longitudinal supports 32 of the base frame 30 so as to be rotatable about its axle 37. The support elements 36 are not rigidly bolted to the longitudinal supports 32, however, but are guided by means of two collar screws each 38*a*, 38*b* in such a way that they are displaceable parallel to the axis 37 for a short distance of the order of magnitude of, for example, 1 to 2 mm. For that purpose the support elements 36 are provided with slot openings 39*a*, 39*b* for the projecting screws 38*a*, 38*b*, which allow an exact lateral guidance of the support elements 36 whilst ensuring their longitudinal displaceability. The collar of the screws 38*a*, 38*b* is somewhat higher than the fixing lugs of the support elements 36, so that the screws 38*a*, 38*b* do not lock the support elements 36. By parallel displacement of the support elements 36 in the slot openings, the distance between the cylindrical surfaces of the rollers 12 and 13 can thus be varied. For that purpose, the machine base frame 30 is provided on its longitudinal supports 32 with a respective fixed stop 40 for actuating devices 41 (displacement elements), which are inset between the fixed stop 40 and the support element 36. The actuating devices 41 are able to determine the position of their corresponding support element 36 with respect to that of the fixed support element 34.

The construction illustrated in the embodiment of FIG. 4 allows the manual adjustment of the distance a between the turning rotor 12 and the combing rotor 13. For this, the threaded spindle 44 has an adjustment nut 42*a* and a lock nut 42*b* in its end region associated with the stop 40.

Figure 4A:
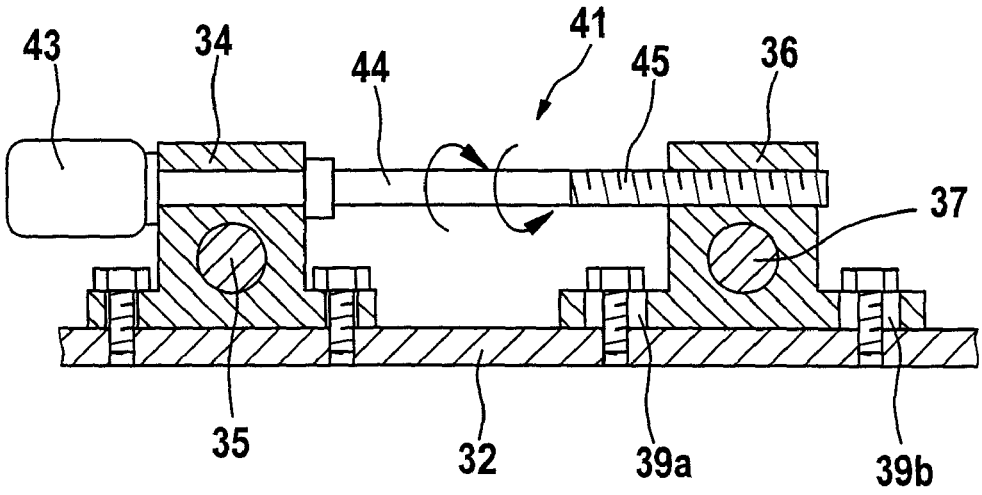
FIG. 4*a* is a detail of a motor-driven actuating device for the distance between turning rotor and combing rotor.

FIG. 4*a* shows an embodiment in which as actuating device 41 a threaded spindle 44 driven by a motor 43 is provided. In this arrangement, the threaded spindle 44 is, for example, mounted rotatably and axially non-displaceably in the fixed support element 34 for the axle 35 of the turning rotor 12, whilst with its other end having the thread 45 it is screwed into the adjustable support element for the axle 37 of the combing rotor 13. By turning the threaded spindle 44 in one direction or the opposite direction, the distance between the axles 35 and 37 can be enlarged or reduced.

Figure 5:
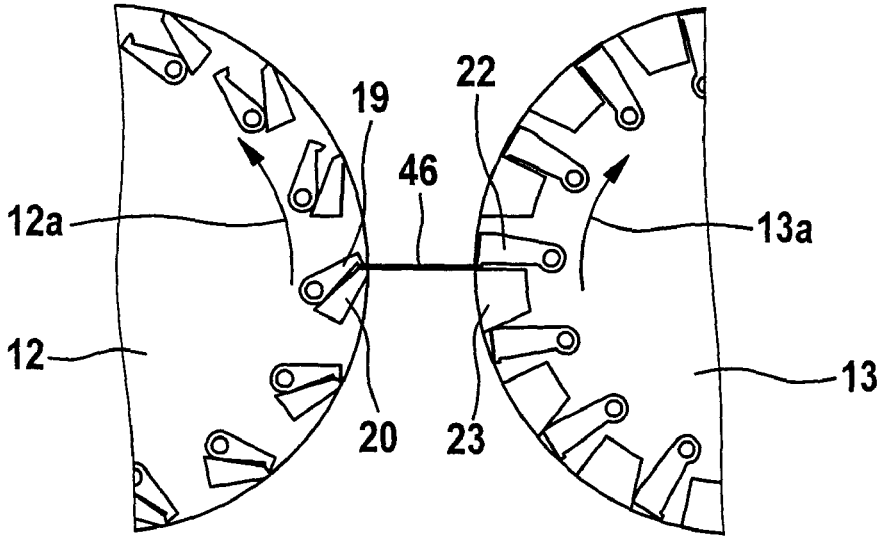
FIG. 5 shows the transfer and take-up of the fibre material from the turning rotor to the combing rotor.

FIG. 5 shows an embodiment in which the transfer or take-up of the fibre material bundle 46 from the turning rotor 12 onto the combing rotor 13 occurs at the narrowest point (distance a) between the rotors 12 and 13. In the position illustrated, the one end region of the fibre bundle 46 is clamped between upper nipper 19 and lower nipper 20 of the closed clamping device 18 and the other end region of the fibre bundle 46 is clamped between the upper nipper 22 and lower nipper 23 of the closed clamping device 21. The fibre bundle 46 has a stretched-out form.

Figure 6:
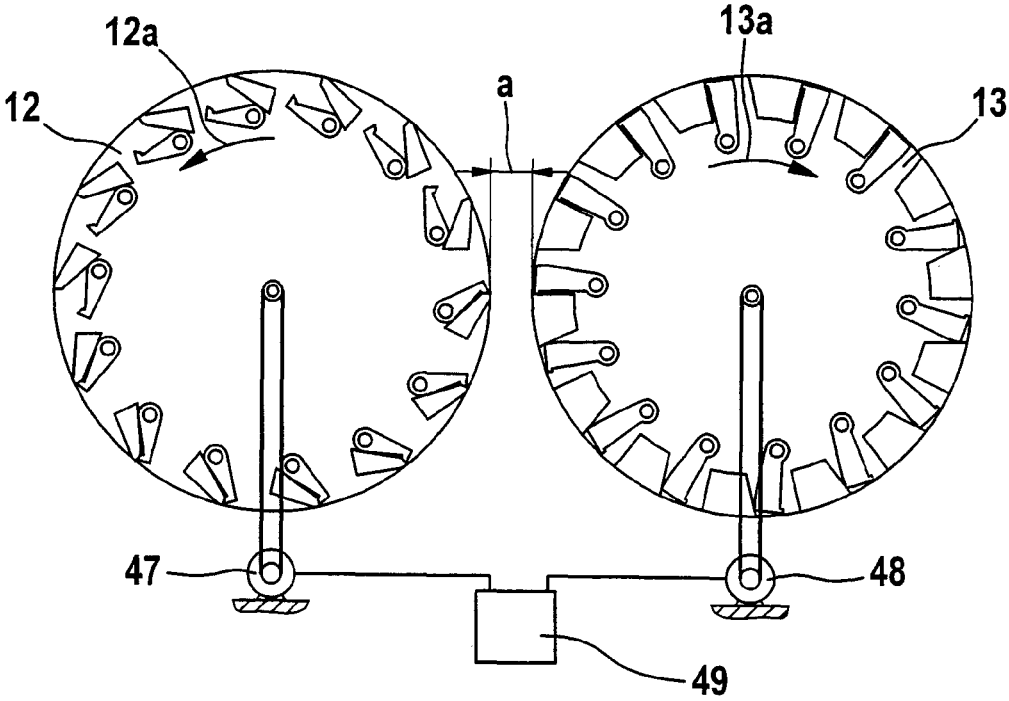
FIG. 6 is a diagrammatic view of the connection of the drive motors for the turning and combing rotors to an electronic control and regulation device.

In the embodiment of FIG. 6, the drive motors 47 and 48 for the turning rotor 12 and combing rotor 13 respectively are connected to a common electrical control and regulation device 49 (drive control). In this way the ratio of the rotary speeds or circumferential speeds of the rotors 12 and 13 with respect to one another can be altered or adjusted. In addition, an offset between the clamping devices 18 and 21, that is a lead or a lag can be set.

Figure 7:
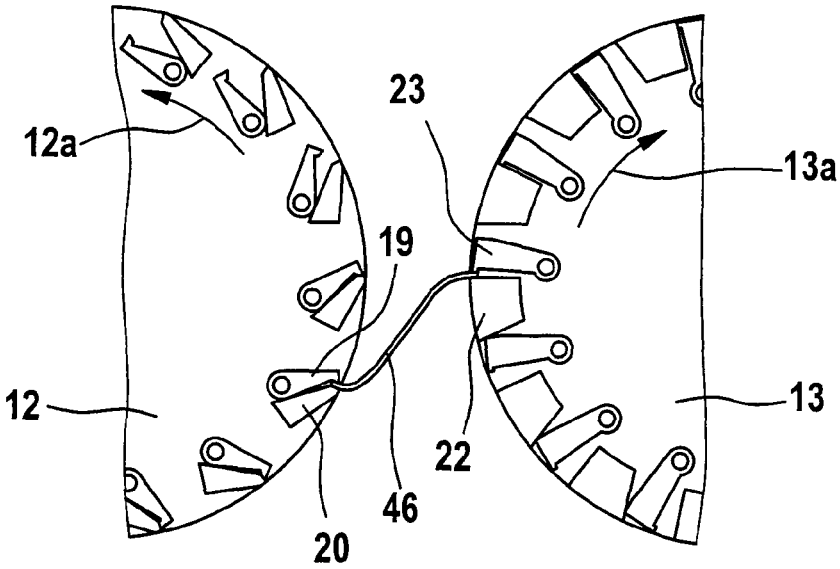
FIG. 7 shows the transfer and take-up of the fibre material from the turning rotor to the combing rotor via an offset.

FIG. 7 illustrates an embodiment having a positive offset, that is to say the combing rotor nippers (clamping device 21) co-operating with the turning rotor nippers (clamping device 18) pass the narrow point (distance a) earlier than the turning rotor nippers (clamping device 18). The fibre bundle 46 has a curved form.

Figure 8:
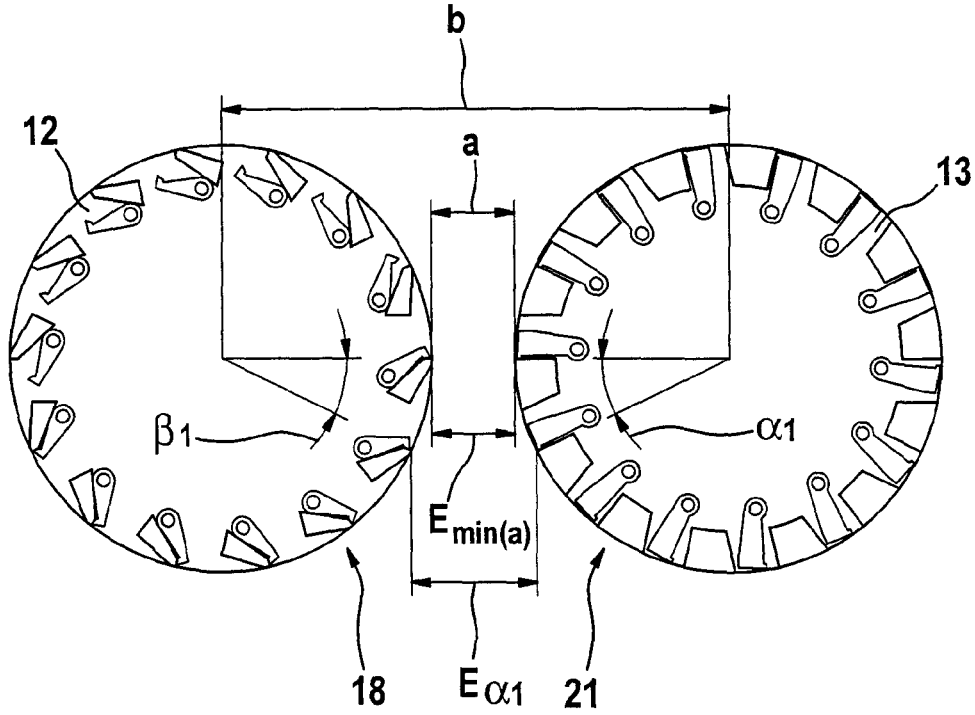
FIG. 8 shows the ecartement displacement across the distance between turning and combing rotor (displacement of $E_{min\ (a)}$) and an illustration of the feasibility of altering the size of the ecartement via the nipper closure time point with constant spacing between turning and combing rotors ($E_{\alpha\ 1}$) offset=0.
Figure 9:
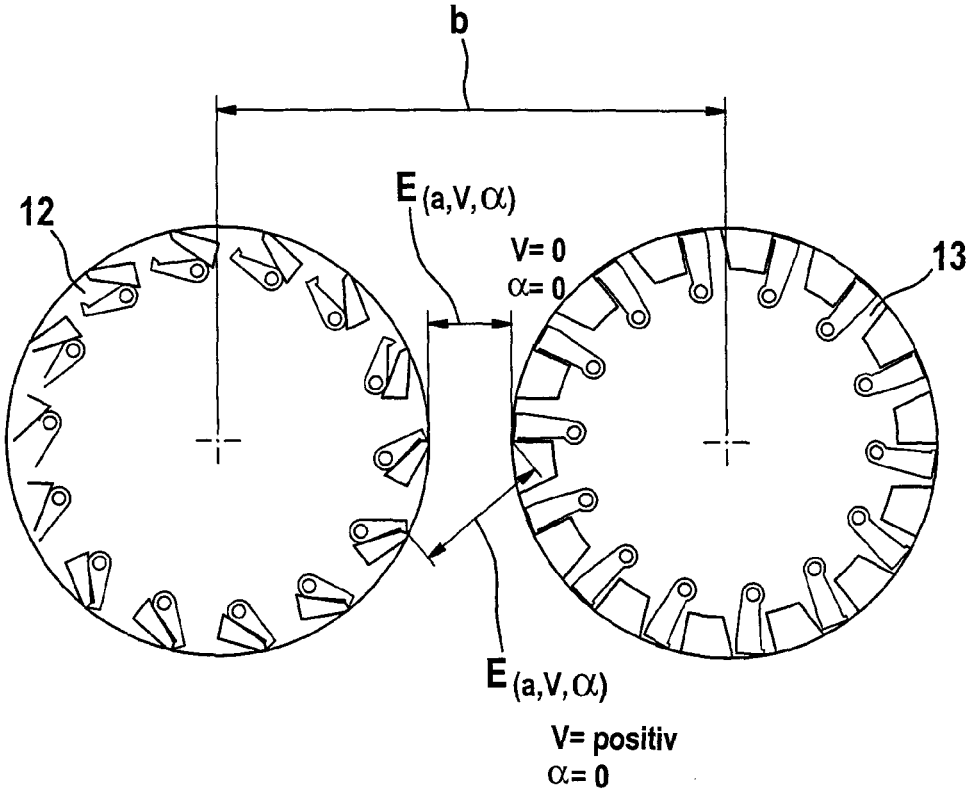
FIG. 9 shows the ecartement displacement over the offset between turning and combing rotors.

FIGS. 8 and 9 show diagrammatically embodiments of adjustment options between turning rotor 12 and combing rotor 13 of a rotor combing machine. Specifically, in the embodiments shown, these are the ecartement adjustment, the adjustment of an offset between combing rotor and turning rotor and the choice of certain speed ratios between the two rotors 12, 13. The said adjustment options are used, for example, for adjustment of the comber waste percentage and to influence the delivery behaviour during transfer of the turning rotor bundle 46 to the combing rotor 13. A number of non-limiting examples of possible adjustment are listed, by way of illustration, below:

- The ecartement (E) can be altered by changing the distance (a) between turning rotor and combing rotor.
- With a constant distance (a) between turning rotor and combing rotor, the ecartement can be altered by the closure time point of the combing rotor nippers 19 (FIG. 8).
- The minimum ecartement is produced on closure of the combing rotor nippers at the narrowest point between turning and combing rotors ($E_{min\ (a)}$) (FIG. 8).
- Otherwise, the resulting écartement is dependent on the combing rotor angular position ($\alpha_1$) with respect to the narrowest distance between turning rotor and combing rotor in which the combing rotor nippers have closed ($E_{\alpha 1}$) (FIG. 8).
- To alter the ecartement in respect of $E_{min}$, the nipper closure time point can be, seen in the direction of rotation of the combing rotor 13, before or after the narrowest point (a) between turning rotor and combing rotor. Preferably, this closure time point occurs before the narrowest point (a) between turning rotor and combing rotor.
- The turning rotor angular position ($\beta_1$) at which the turning rotor nippers 18 open and release the turning rotor tuft 46 for transfer to the combing rotor 13 is dependent on the nipper closure time point of the combing rotor nippers 21.
- FIG. 9 illustrates embodiments in which the combing rotor nippers close at the narrowest point (a) between the turning and combing rotors and therefore the combing rotor angular position with respect to the narrowest distance is Zero ($\alpha$=0).
- The offset (V) between the turning rotor 12 and the combing rotor 13 amounts to zero (V=0) when the co-operating combing rotor nippers and turning rotor nippers pass the narrow point between the turning rotor 12 and the combing rotor 13 at the same time.
- With a positive offset (V>0), the combing rotor nippers 21 co-operating with the turning rotor nippers 18 pass the narrow point (a) earlier than the turning rotor nippers 18.
- With a negative offset (not illustrated in FIG. 9), the combing rotor nippers 21 co-operating with the turning rotor nippers 18 pass the narrow point (a) later than the turning rotor nippers 18.
- By changing the offset, it is possible, for example, to influence the transfer behaviour on transfer of the turning rotor bundle 46 to the combing rotor 13.
- By changing the offset, it is possible for example, to influence the magnitude of the ecartement in addition to the parameters of the nipper closure time point of the combing rotor nippers 18 and the distance (a) between turning rotor and combing rotor (FIG. 9).
- The combing rotor 13 and the turning rotor 12 may have identical peripheral speeds.
- The combing rotor 13 and the turning rotor 12 may have different peripheral speeds, so that different speed ratios are adjustable between the rotors 12, 13 (cf. FIG. 6).
- The speed ratios can be adjusted dependent on the selected nipper spacings on the turning rotor 12 and on the combing rotor 13.
- With identical nipper spacing, the speed of the one rotor 12 or 13 is always a multiple of that of the respective other rotor 13 or 12.
- With correspondingly matched nipper spacings on the rotors 12, 13, any speed ratios can be set.
- The speed ratio between the rotors 12, 13 has, for example, an influence on transfer behaviour during transfer of the fibre tuft 46 from the turning rotor 12 onto the combing rotor 13.

Reference letter b denotes the distance between the centre points of the turning rotor 12 and the combing rotor 13.

Figure 10:
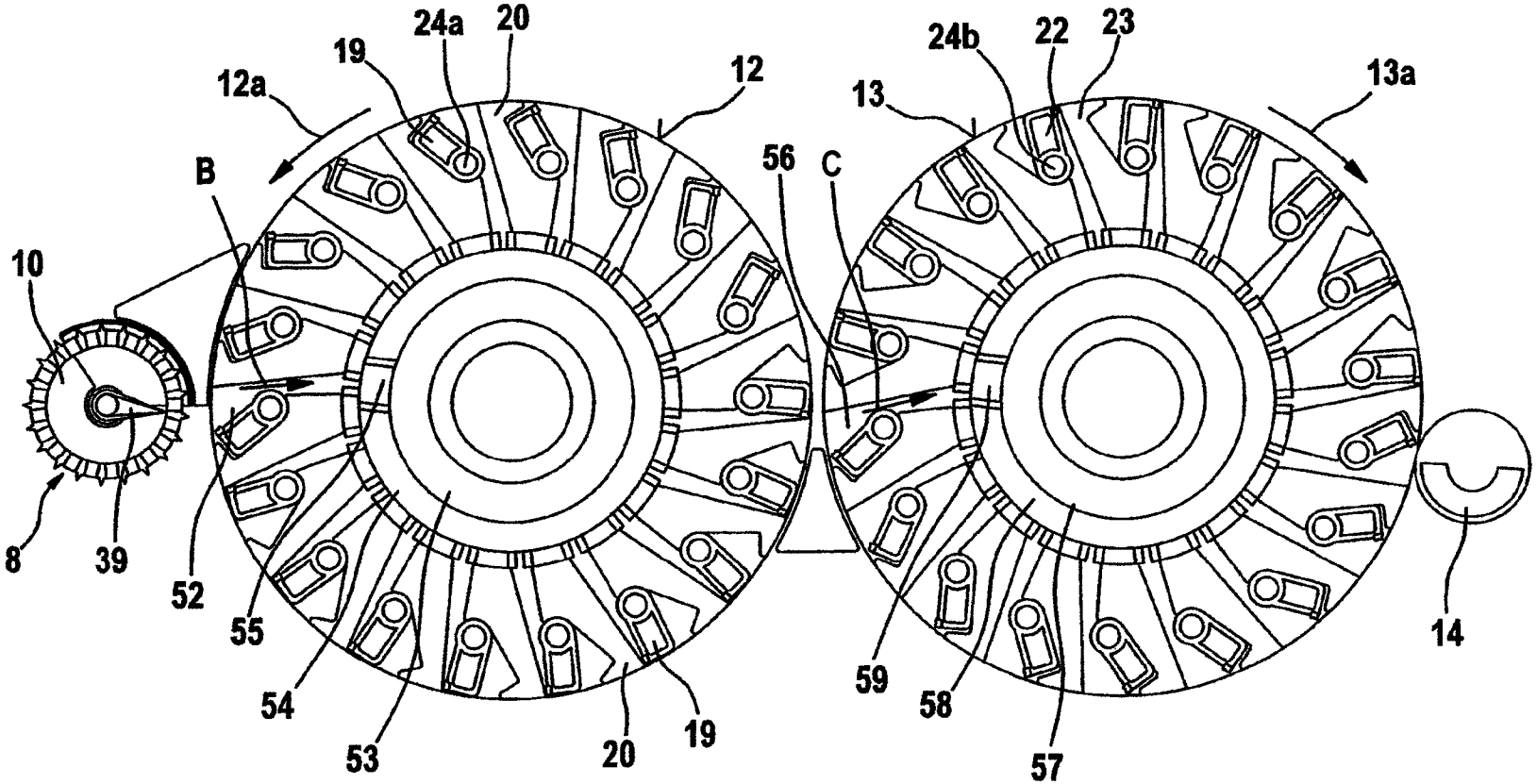
FIG. 10 shows a rotor combing machine according to the invention, in which suction devices are associated with the clamping devices.

In the embodiment of FIG. 10, the rotatably mounted rollers 12 and 13 with clamping devices 19, 20 and 22, 23 respectively are additionally fitted with suction channels 52 and 56 respectively (suction openings) which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure region 53 to 55 and 57 to 59, respectively, created by the suction flow at the suction openings 52, 56. The reduced pressure can be generated by connecting to a flow-generating machine. The suction flow B, C at the individual suction openings 52, 56 can be switched between the reduced pressure region and suction opening so that it is applied only at particular selected angular positions on the roller circumference. For the purpose of the switching, valves or a valve pipe 54, 58 with openings 55 and 59, respectively, in the corresponding angular positions can be used. The release of the suction flow may also be brought about by the movement of the gripping element (upper nipper). Furthermore, it is possible to arrange a region of reduced pressure only at the corresponding angular positions.

Additionally, a flow of blown air can be provided in the region of the supply device 8 and/or in the region of transfer between the rollers. In the case of the supply device, the source of the flow of blown air (blowing nozzle 39) is arranged inside the feed roller 10 and acts, through the air-permeable surface of the supply device or through air passage openings, towards the outside in the direction of the first roller. Also, in the region of the supply device 8, the element for producing the blown air current can be fixedly arranged, directly under or over the supply device 8. In the region of the transfer between the rollers 12, 13 the blown air current sources can be arranged at the rotor perimeter of the first roller 12, directly under or over each nipper device. For the blown air generation there may be used compressed air nozzles or air blades.

It will be appreciated that a suction arrangement and/or a blowing arrangement, for example as described with reference to FIG. 10, may be provided in any of the embodiments of FIGS. 1 to 9 for influencing transfer of the fibre bundles from first roller 12 to second roller 13 and, in particular, for facilitating uptake of the respective bundle by a co-operating clamping device of roller 13.

The combed-out fibre bundle (not shown) passes from the second roller 13 onto the piecing roller 14.

The circumferential speeds are, for example, for the feed roller about from 0.2 to 1.0 m/sec; the first roller 12 about from 2.0 to 6.0 m/sec; the second roller 13 about from 2.0 to 6.0 m/sec; the doffer about from 0.4 to 1.5 m/sec; and the revolving card top assembly about from 1.5 to 4.5 m/sec. The diameter of the first roller 12 and the second roller 13 is, for example, about from 0.3 m to 0.8 m.

Using the rotor combing machine 2 according to the invention, more than 2000 nips/min, for example from 3000 to 5000 nips/min, are achieved.

Using the rotor combing machine according to the invention there is achieved a mechanical combing of the fibre material to be combed out, that is, mechanical means are used for the combing. In some embodiments, there is no pneumatic combing of the fibre material to be combed, that is, no air currents, e.g. suction and/or blown air currents, are used for combing.

In the rotor combing machine according to the invention there are present rollers that rotate rapidly without interruption and that have clamping devices. Preferably, rollers that rotate with interruptions, stepwise or alternating between a stationary and rotating state are not used.

Although the foregoing invention has been described in detail by way of illustration and example for purposes of understanding, it will be obvious that changes and modifications may be practised within the scope of the appended claims.

What we claim is:

1. An apparatus for the fibre-sorting or fibre selection of a fibre bundle comprising textile fibres, the apparatus comprising:

a fibre sorting device comprising at least a first roller and a second roller that rotate rapidly without interruption during use, the first roller and the second roller each having clamping devices that clamp the fibre bundle distributed about their periphery;

a supply device adapted to supply a fibre bundle to the fibre sorting device;

a mechanical device adapted to generate a combing action in order to loosen and remove non-clamped constitutes from the fibre bundle;

a take-off device adapted to remove the combed fibre material from the fibre-sorting device; and at least one adjustment device associated with at least one of said first and second rollers, wherein the at least one adjustment device is adapted to adjust an offset between the clamping devices of the first roller and the second roller.

2. An apparatus according to claim 1, wherein the first roller is a turning rotor and the second roller is a combing rotor of a rotor combing machine.

3. An apparatus according to claim 1, wherein the at least one adjustment device is adapted to adjust an écartement between a first clamping device on the first roller and a second clamping device on the second roller.

4. An apparatus for the fibre-sorting or fibre selection of a fibre bundle comprising textile fibres, the apparatus comprising:

a fibre sorting device comprising at least a first roller and a second roller that rotate rapidly without interruption during use, the first roller and the second roller each having clamping devices that clamp the fibre bundle distributed about their periphery;

a supply device adapted to supply a fibre bundle to the fibre sorting device;

a mechanical device adapted to generate a combing action in order to loosen and remove non-clamped constitutes from the fibre bundle;

a take-off device adapted to remove the combed fibre material from the fibre-sorting device; and at least one adjustment device adapted to adjust specific speed ratios between the second roller and the first roller.

5. An apparatus for the fibre-sorting or fibre selection of a fibre bundle comprising textile fibres, the apparatus comprising:

a fibre sorting device comprising at least a first roller and a second roller that rotate rapidly without interruption during use, the first roller and the second roller each having clamping devices that clamp the fibre bundle distributed about their periphery;

a supply device adapted to supply a fibre bundle to the fibre sorting device;

a mechanical device adapted to generate a combing action in order to loosen and remove non-clamped constitutes from the fibre bundle;

a take-off device adapted to remove the combed fibre material from the fibre-sorting device; and at least one adjustment device adapted to adjust the distance between the first roller and the second roller.

6. An apparatus for the fibre-sorting or fibre selection of a fibre bundle comprising textile fibres, the apparatus comprising:

a fibre sorting device comprising at least a first roller and a second roller that rotate rapidly without interruption during use, the first roller and the second roller each having clamping devices that clamp the fibre bundle distributed about their periphery;

a supply device adapted to supply a fibre bundle to the fibre sorting device;

a mechanical device adapted to generate a combing action in order to loosen and remove non-clamped constitutes from the fibre bundle;

a take-off device adapted to remove the combed fibre material from the fibre-sorting device; and at least one adjustment device adapted to adjust the peripheral speed of at least one of the first and second rollers.

7. An apparatus for the fibre-sorting or fibre selection of a fibre bundle comprising textile fibres, the apparatus comprising:

a fibre sorting device comprising at least a first roller and a second roller that rotate rapidly without interruption during use, the first roller and the second roller each having clamping devices that clamp the fibre bundle distributed about their periphery;

a supply device adapted to supply a fibre bundle to the fibre sorting device;

a mechanical device adapted to generate a combing action in order to loosen and remove non-clamped constitutes from the fibre bundle;

a take-off device adapted to remove the combed fibre material from the fibre-sorting device;

at least one adjustment device associated with the first and second rollers, the at least one adjustment device adapted to adjust geometric and/or speed related variables in the relationship of said first roller and said second roller; and at least one suction device located in a region of transfer of the fibre material from the first roller to the second roller for suction of the fibre bundle, the suction device being associated with the clamping devices.

8. An apparatus according to claim 1, wherein said first roller and said second roller are arranged to have different directions of rotation.

9. A method of combing fibre material using an apparatus for the fibre-sorting or fibre selection of a fibre bundle comprising textile fibres, the apparatus comprising:

a fibre sorting device having clamping devices adapted to clamp the fibre bundle;

a supply device adapted to supply a fibre bundle to the fibre sorting device;

a mechanical device adapted to generate a combing action in order to loosen and remove non-clamped constitutes from the fibre bundle; and a take-off device adapted to remove the combed fibre material from the fibre-sorting device;

wherein the fibre sorting device comprises, arranged downstream of the supply device, at least first and second rollers which, in use, rotate rapidly without interruption, at least one of the first and second rollers having clamping devices distributed spaced apart about its periphery, and at least one adjustment device associated with at least one of the first and second roller, the at least one adjustment device adapted to adjust geometric and/or speed related variables in the relationship of said first roller and said second roller, the method comprising:

feeding a fibre sliver or lap to said first roller having at least one clamping device, rotating the first roller continuously whereby a bundle of fibres is torn away from the sliver or lap and rotates with the first roller, transferring the bundle to a co-operating clamping device on said second roller such that the bundle is held on said second roller with a first end unclamped and a second end clamped, rotating the bundle with said second roller, positioning the bundle during said rotation such that a free end thereof can be combed by said mechanical combing device, and adjusting the geometric and/or speed-related variables in the relationship of the first and second rollers.

10. A method according to claim 9, wherein said first roller is a turning rotor and said second roller is a combing rotor.

11. A method according to claim 9, wherein the adjustment influences transfer of the bundle from said first roller to said second roller.

12. A method according to claim 9, wherein the écartement is adjusted.

13. A method according to claim 12, further comprising maintaining a constant distance between said first roller and said second roller, and altering the écartement by adjusting a closure time point of the clamping device on said second roller.

14. A method according to claim 12, wherein the écartement is dependent on an angular position of the second roller with respect to a narrowest distance between said first roller and said second roller in which said co-operating clamping device on the second roller has closed.

15. A method according to claim 12, further comprising influencing the magnitude of the écartement by changing an offset between a clamping device on said first roller and a co-operating clamping device on said second roller.

16. A method according to claim 9, further comprising closing a co-operating clamping device on said second roller before the co-operating clamping device reaches the narrowest point between said first roller and said second roller.

17. A method according to claim 9, further comprising closing a co-operating clamping device of said second roller after the co-operating clamping device reaches the narrowest point between said first roller and said second roller.

18. A method according to claim 9, further comprising adjusting an angular position at which the at least one clamping device on said first roller opens and releases the bundle for transfer to said second roller dependent on a point in time at which a co-operating clamping device on said second roller closes.

19. A method according to claim 9, wherein co-operating clamping devices on said first and second rollers pass the narrowest point between the first and second rollers at the same time.

20. A method according to claim 9, wherein said clamping device on said first roller passes the narrowest point between said first and second rollers earlier than the co-operating clamping device on said second roller.

21. A method according to claim 9, wherein the clamping device on said first roller passes the narrowest point between said first and second rollers later than the co-operating clamping device on said second roller with which it co-operates.

22. A method according to claim 9, wherein said first roller and said second roller have different peripheral speeds, the method further comprising adjusting the speed ratio of said first roller and said second roller in dependence on selected spacings between the clamping devices on the first and second rollers.

23. A method according to claim 9, wherein the speed ratio between the rollers influences the transfer of the fibre bundle from the first roller onto the second roller.

24. A method according to claim 9, wherein the offset between a clamping device on the first roller and a co-operating clamping device on the second roller influences the transfer of the fibre bundle from the first roller onto the second roller.

* * * * *